US005632485A

United States Patent [19]

Woodland et al.

[11] Patent Number: 5,632,485

[45] Date of Patent: May 27, 1997

[54] CARD GAME WITH SIDE BET OPTIONS

[76] Inventors: Bill M. Woodland; Linda M. Woodland, both of 22 Harvard Pl., Ann Arbor, Mich. 48104

[21] Appl. No.: 453,748

[22] Filed: May 30, 1995

[51] Int. Cl.[6] ..... A63F 1/00

[52] U.S. Cl. ..... 273/292; 273/274; 273/309; 463/12

[58] Field of Search ..... 273/292, 274, 273/309, 138.2; 463/12

[56] References Cited

U.S. PATENT DOCUMENTS 5,098,107 3/1992 Boylan et al. ..... 273/292

OTHER PUBLICATIONS

"Over/Under 13", Gaming Concepts Inc., 1988.

*Primary Examiner*—Benjamin H. Layno
*Attorney, Agent, or Firm*—Galgano & Burke

[57] ABSTRACT

A game of Blackjack or "Twenty-One" is modified by providing a player with the option of wagering on whether the player will receive a "stiff" hand. As used herein, the term "stiff" is defined as occurring when the first two cards dealt to a player have a hard total of 12 to 16, i.e. 12, 13, 14, 15 or 16, when aces are counted as one. According to another embodiment, a player in a Blackjack game is provided with the option of wagering on whether he will be dealt a non-pair "stiff" hand or a pair of aces. According to a still further embodiment, a player in a Blackjack game is provided with the option of wagering on whether his first two cards will result in a "stiff" hand or a "soft" hand, i.e. that the player's first two cards include an ace and either: 1) any non-ten denomination, i.e., ace through nine or 2) any non-ten and non-ace denomination, i.e. two through nine.

29 Claims, 2 Drawing Sheets

CARD GAME WITH SIDE BET OPTIONS

The present invention relates to card games and, more particularly, to variations of Blackjack which provide at least one player with the options to make at least one sidebet.

BACKGROUND OF THE INVENTION

Red Dog, Pai Gow Poker, and more recently, Caribbean Stud Poker, represent new games that have been introduced relatively recently to the gaming public. Double exposure Blackjack, and crapless craps are some examples of rule variations on existing table games. As is common with new product introductions in general, although the new game initially generates reasonable profits to the casino, they dissipate as the novelty wears off. This can be attributed to various factors ranging from boredom with the game to a realization by the player of a low expected return. While many gamblers appear willing to experiment with a new game, in an optimistic search for the game that they can beat, they are unlikely to make a permanent commitment. This continued experimentation with new betting propositions by gaming establishments may be tolerable, especially if the games can be introduced with relatively minor costs, both direct and indirect. The direct costs are those associated primarily with the retraining of labor in the operation of the new game. In addition, there are the indirect or opportunity costs of new games which are incurred as the new games displace established table games in the casino. In this respect, sidebets on existing games are particularly attractive as they allow the casinos an opportunity to stimulate action on these games, while minimizing both of the introduction costs. Blackjack or "Twenty-One" is a popular card game of chance which is played in gaming establishments throughout the world. In a typical Blackjack game, each player places his initial wager, also known as his "ante", before any cards are dealt The wager can be any amount, at a player's direction, between the minimum and maximum limits set by the rules of the gaming establishment. Each player is then dealt two cards, both of which are commonly face down, and the dealer is dealt two cards, one of which is commonly face down and one of which is commonly face up. Each player, in turn, then takes as many "hits" (additional cards) as he elects until he either "stands" (stops with hand count less than or equal to twenty-one) or "busts" (hand count exceeds twenty-one). Each player may stand with any hand count of twenty-one of less. If a player busts, he loses his wager, regardless of whether or not the dealer busts.

After each of the players, in turn, has taken as many hits as he elects and has stood on his hand or busted, the dealer then turns over his face down card and then either stands on his hand or takes hits in accordance with the house rules. Conventionally, the house rules require that the dealer stand on his hand if he has a hand count of seventeen or more and require that he take hits, if his initial hand count is sixteen or less, until he attains a hand count of seventeen or more. After obtaining a hand count of seventeen or more, the dealer is typically not allowed to take additional hits, unless one of his cards is an ace.

Under the conventional manner of play, the house rules require that the dealer take a hit if his initial hand is an ace and a six ("soft" seventeen), or if, after receiving one or more hits, the dealer's hand consists of an ace and two or more cards that add up to a card count of six. Also under the conventional manner of play, the dealer is required to stand if his initial hand is a soft eighteen, soft nineteen or soft twenty, and the ace is then counted with a card count of eleven.

If the dealer busts, each player who has not busted wins. If the dealer does not bust, then the hand count for each player is compared with the hand count of the dealer. If the hand count of a player exceeds that of the dealer, the player wins. He is commonly paid on a 1:1 basis. If the hand count of the dealer exceeds that of the player, the player loses. If the player's hand count ties that of the dealer, it is called a "push" and the rules of play used by the gaming establishment may provide that the player loses his wager or that the player's wager is returned to him.

The conventional method of playing twenty-one which is utilized by most gaming establishments, also includes at least three well-known procedures. These are "insurance", "doubling down" and "splitting pairs".

After each player and the dealer receives their first two cards, if the dealer's "up" card is an ace, each player may elect to make an "insurance" bet. The amount of the insurance bet, for each player making the election, is most often limited to one-half of the amount of his original ante. Then the dealer, without turning over his face down card, checks the face down card, and if the dealer has a Blackjack (a two card, twenty-one count hand), he then turns over the face down card. Each player placing an insurance bet wins and is paid on a 2-to-1 basis for the insurance bet only. All players who do not also have a two card, twenty-one count hand (a Blackjack), lose their original ante regardless of their insurance bet. Each player also having a two card twenty-one count hand has his ante returned to him or loses his ante, depending on the house rules.

Another well known procedure utilized by gaming establishments is "doubling down". The initial two card, hand counts total which permit a player to elect to "double down" is established by house rules. The three most common double down hand counts utilized by gaming establishments are (a) nine, ten, or eleven; (b) ten or eleven; or (c) eleven only. If the player has an initial two card hand count total equal to one of the values established by the house rules, he may elect to double down. The player informs the dealer of his election to double down and places an additional wager up to the amount of his original ante. The dealer then deals to that player one and only one additional card, face down, and the resulting three card hand establishes the final count for that player's hand. The player's three card hand count is compared with the dealer's final hand count and the amount of the player's wager is the total of the original ante and the double down bet.

Another well known procedure utilized by gaming establishments is "splitting pairs". For example, if the first two cards of a player's hand are a pair or are both ten count cards, that player may elect to "split" the initial two cards into two separate hands. The player then applies his original ante to one of the two hands and places an additional ante for the other hand. Both of the original two cards are then turned face up and the player plays each of two hands as a separate hand in accordance with the house rules. Some Gaming establishments only allow splitting if the player's first two cards are a true pair. House rules also may allow a player to double down and may allow him to place an insurance bet on either or both hands.

While previous versions of Blackjack have permitted players to make additional wagers after at least some cards have been displayed, it is desirable to increase the player's interest in a game by permitting additional opportunities for sidebets even before any cards have been displayed.

It would also be desirable to increase player's wagering options in a manner which enhances player interest without significantly lengthening the average time needed to play a hand.

It would also be desirable to provide a sidebet which would soften the impact of streaks of stiff hands which might tend to discourage players and expedite their exit from the game. Players who are suspicious of a dealer's integrity in providing an honest shuffle/deal would be reassured by the knowledge that it is no longer in the house's best interest to deal a player a stiff hand.

Furthermore, it would be particularly desirable to provide a novel game which can be implemented with minimal introduction costs.

These and other advantages are provided by the various embodiments of the present invention which are described herein.

SUMMARY OF THE INVENTION

According to the various embodiments of the present invention, a game of Blackjack or "Twenty-One" is enhanced by providing a player with the option of wagering on whether the player will receive a "stiff" hand. As used herein, the term "stiff" is defined as occurring when the first two cards dealt to a player have a hard total of 12 to 16, i.e. 12, 13, 14, 15 or 16. Those skilled in the art will appreciate that "hard" as used herein indicates that aces are counted as one for the sidebets. According to a preferred embodiment, winning "stiff insurance" bets are preferably paid favorable odds, for example 3:2 odds.

According to another embodiment of the present invention, a player in a Blackjack game is provided with the option of wagering on whether the player will be dealt a non-pair "stiff" hand or a pair of aces.

According to a still further embodiment of the present invention, a player in a Blackjack game is provided with the option of wagering on whether the first two cards will result in a "stiff" hand or a "soft" hand. As used herein, the term "soft" is used to indicate that the player's first two cards include an ace and any non-ten denomination, i.e., ace through nine.

These and other embodiments of the present invention are described in further detail below.

DETAILED DESCRIPTION

The various embodiments of the present invention provide novel betting options to the game of Blackjack. According to the various embodiments of the present invention, each player is provided with an opportunity to make at least one wager on whether the first two cards displayed to that player will have at least one of a plurality of predetermined values, before cards are displayed to the player.

While it is not absolutely necessary in order to enjoy the advantages of the present invention, it is anticipated that players will first participate in a main Blackjack bet, as in a conventional Blackjack game, and then have the option of participating in one or more sidebets. Furthermore, while the illustrated embodiments of the present invention are in the form of a game table and a gaming device, it is not absolutely necessary that this game be played utilizing any particular layout or device.

According to one preferred embodiment of the present invention, a player may purchase "stiff insurance" with a sidebet. In this regard, a player is provided with the option of wagering on whether he will be dealt a "stiff" hand which, as explained above, occurs when the first two cards dealt to a player have a hard total of twelve to sixteen, inclusive. For purposes of determining the value of the sidebet, aces are counted as one.

Figure 1:
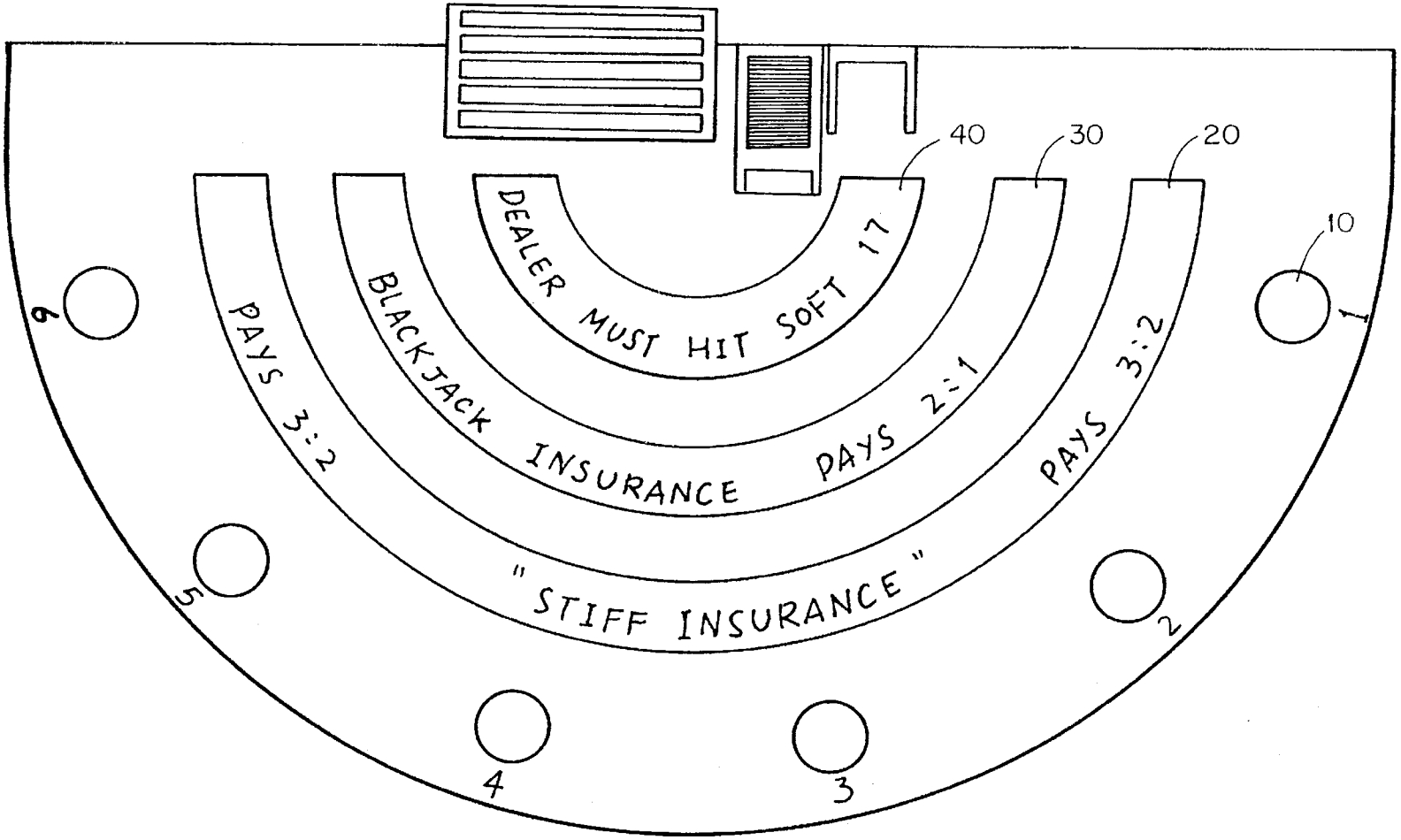
FIG. 1 illustrates a table layout of one embodiment of the present invention.

With reference to FIG. 1, one game layout is illustrated wherein six wagering areas 10 are provided for receiving the main bets or "antes" of a plurality of players. In addition to placing a main wager, each player is provided with the option of making a sidebet by placing a wager in wagering area 20 proximate to that player's wager. Additional wagering areas may be provided for additional sidebets. The table layout shown in FIG. 1 is merely illustrative is not intended to limit the scope of the present invention. For example, players may be provided with multiple options of "stiff" type insurance, as well as other sidebets previously known in the art. While this illustrated embodiment of the present invention indicates that a player will receive a winning payout at 3:2 odds, the amount of such payouts can be determined by the gaming establishanent.

After players have placed their desired wagers, each player is displayed two cards. At this time, a dealer also preferably receives two cards which are most preferably dealt one card face down and one card face up. Play then commences according to rules established by the gaming establishment. For example, a player may also be provided with additional options of placing sidebets, such as buying "insurance", for example if a dealer has an ace showing. The side wagers can be resolved either after all cards in a given hand have been dealt and/or displayed or when the outcome of the sidebet has been determined. For example, if desired, the stiff insurance wagers can be paid after two cards have been displayed to a player who has made a "stiff insurance" wager.

According to an alternative embodiment of the present invention, a player is provided with the opportunity of acquiring "pairless-stiff insurance" by wagering that the first two cards displayed to that player will be a non-pair "stiff" hand or a pair of aces. While each player who is displayed a "pairless-stiff" or a pair of aces in the first two cards may receive the same payout, it is also within the scope of the present invention to provide different payouts for a non-pair "stiff" hand and a pair of aces. For example, a player may receive a payout of 3:2 for a non-pair "stiff" while a player may be provided with a greater payout such as 5:1 for a pair of aces. Furthermore, while the embodiment of the present invention illustrated in FIGS. 1 and 2 only provides a single "stiff" sidebet option, it is also within the scope of the present invention to provide multiple sidebet wagering options. Those skilled in the art will appreciate that different wagering options may pay either the same odds or may pay different odds. Therefore, a single game layout or gaming device, such as the gaming device shown in FIG. 2, may offer a player multiple options for placing sidebet wagers.

According to a third embodiment of the present invention, a player has the option of wagering on whether the first two cards displayed will result in a "stiff" or "soft" hand. According to this embodiment of the present invention, a "stiff" hand occurs as described above while a "soft" hand occurs when an ace is paired with either: 1) any card having a value other than ten, i.e., an ace through nine, or 2) any card having a value other than ten or an ace, i.e., a two through nine.

As stated above, the various methods of the present invention can be played on a variety of table layouts, gaming devices, or simply with one or more decks of cards. According to the illustrated embodiments, players place their bets on the main bets and sidebets prior to the display of cards. While the main or "ante" bets and sidebets can be of equal value, it is also within the scope of the present invention to place restrictions on the relative sizes of the main bet and sidebet. For example, the gaming establishment may require that the sidebet does not exceed more than one-half the value of the main bet.

Figure 2:
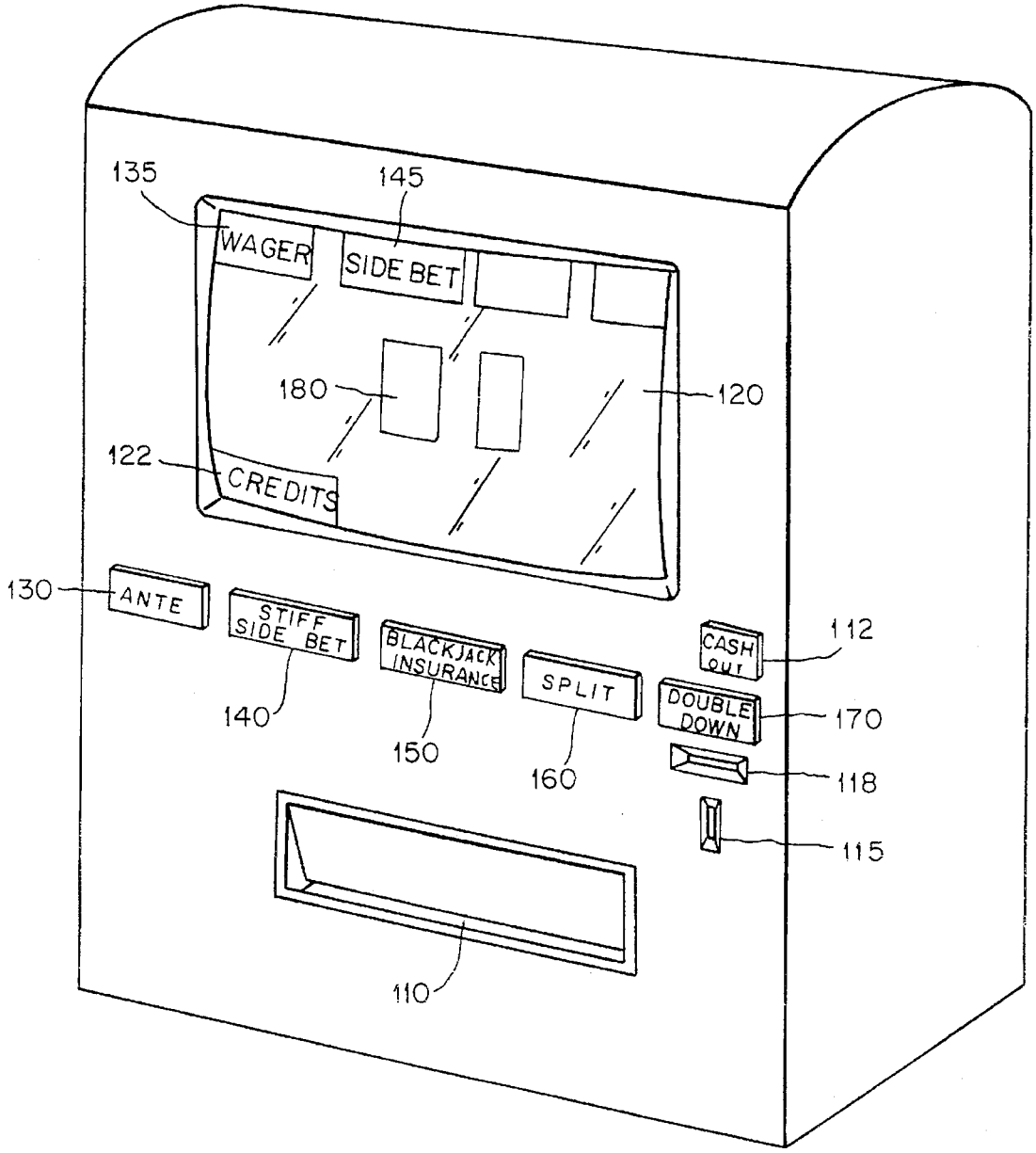
FIG. 2 illustrates a gaming device of an alternative embodiment of the present invention.

FIG. 2 illustrates an electronic gaming device embodiment of the present invention wherein a gaming device is provided with a screen 120 for displaying a plurality of indicia of cards and such other information commonly displayed by gaming devices, such as the credits which a player has accumulated in credit area 122, the amount wagered in WAGER window 135, and the view of a sidebet in SIDEBET area 145. Other portions of the screen may also be reserved for additional sidebets. The gaming device is also provided with a coin trough 110, a coin slot 115, and a currency/card validator 118. In addition, a plurality of buttons may be provided to enable a player to provide input to the game. For example, an ANTE button 130 may be provided to allow the player to establish the amount of his main bet. At least one SIDEBET button 140 is provided in order to allow the player to indicate when the player wishes to place a sidebet by depressing the SIDEBET button 140. Other buttons may also be provided to permit other wagering options. For example, a player may be provided with the option of buying BLACKJACK INSURANCE with button 150, splitting his initial hand with SPLIT button 160 or doubling downwith DOUBLE DOWN button 170.

Upon inserting sufficient coins, currency or other value into the gaming device, a player will be permitted to place a wager in a desired amount by depressing ANTE button 130 and, if desired, STIFF SIDEBET button 140. The player's initial two cards 180 will then be displayed on SCREEN 120, as well as indicia of the dealer's hand which will either comprise two cards face down or one card face up and one card face down (not shown). The player then plays out his hand in a conventional manner. Those skilled in the art will appreciate that certain hands will enable a player to pursue other wagering options as indicated by BLACKJACK INSURANCE button 150, SPLIT button 160 and DOUBLE DOWN button 170. In a manner well known in the art, a player can continue to play this illustrated gaming device for extended periods of time by simply playing against his credits. When a player desires to stop playing the illustrated gaming device, he can simply depress CASE OUT button 112 and receive his winnings in COIN TROUGH 110.

While the various embodiments have been described as being played between a house dealer and a plurality of players, it is also within the scope of the present invention to rotate the deal among players.

From the present invention, those skilled in the art will appreciate that the various embodiments of the present invention provide novel sidebets for the game of Blackjack and thereby enhance player interest and the level of excitement of the game. Since streaks of stiff hands in conventional Blackjack games could tend to discourage players and promote their exit from the game, the present invention provides sidebet opportunities which allow a player to transform these "bad streaks" into profitable opportunities. By "hedging" against stiffs, participants can play through runs of bad luck, thereby increasing the gaming establishment's Blackjack action from both the main bets and sidebets.

Another advantageous feature of the present invention is the opportunity to provide sidebets which pay higher odds to the players thereby increasing the attractiveness of this novel game. Those skilled in the art will appreciate that many players have a preference for games offering higher odds.

Still furthermore, the various embodiments of the present invention can be added to a conventional game of Blackjack with minimal introduction costs to a gaming establishment. One or more sidebets can be added with minor revisions to a typical table layout and required staff training is minimal.

What is claimed is:

1. A method of playing a card game comprising the steps of:

providing a deck of cards comprising a plurality of different numerical values;

providing at least one player with the opportunity to place a single wager on whether the first two cards displayed to said player will be one of a predetermined plurality of two-card winning combinations, and wherein said plurality of two-card winning combinations comprises a first winning combination of cards having a cumulative value of twelve and a second winning combination of cards having a cumulative value of thirteen to sixteen initially displaying two cards to each player; and resolving each wager by providing a winning payout to a player who placed a correct wager.

2. A method of playing a card game according to claim 1 wherein said cards are displayed on a game board.

3. A method of playing a card game according to claim 1 wherein said cards are displayed on an electronic screen.

4. A method of playing a card game according to claim 1 further comprising the steps of:

requiring each player to wager on whether the player's hand will have a cumulative value which is closer to a predetermined value than a dealer's hand; and displaying a dealer's hand.

5. A method of playing a card game according to claim 4 wherein said predetermined value is twenty-one.

6. A method of playing a card game according to claim 5 wherein said predetermined plurality of two-card winning combinations comprises a pair of aces.

7. A method of playing a card game according to claim 6 wherein said two-card winning combination, with the exception of aces, must be a non-pair.

8. A method of playing a card game according to claim 5 wherein said plurality of two-card winning combinations comprises an ace and another card which has a value other than ten.

9. A method of playing a card game according to claim 5 wherein said plurality of two-card winning combinations comprises an ace and another card having a value of two through nine.

10. A method of playing a card game according to claim 1 wherein said predetermined plurality of two-card winning combinations comprises a pair of aces.

11. A method of playing a card game according to claim 10 wherein said two-card winning combination, with the exception of aces must be a non-pair.

12. A method of playing a card game according to claim 1 wherein said plurality of two-card winning combinations comprises an ace and another card which has a value other than ten.

13. A method of playing a card game according to claim 1 wherein said plurality of two-card winning combinations comprises an ace and another card having a value of two through nine.

14. A method of playing a Blackjack game providing a deck of cards comprising a plurality of different numerical values, wherein at least one player is provided with the opportunity to place a single wager on whether that player's first two cards will be one of a predetermined plurality of two-card winning combinations, and wherein said plurality of two-card winning combinations comprises a first winning combination of cards having a cumulative vlaue of twelve and a second winning combination of cards having a cumulative value of thirteen to sixteen.

15. A method of playing a Blackjack game according to claim 14 wherein said cards are displayed on a game board.

16. A method of playing a Blackjack game according to claim 14 wherein said cards are displayed on an electronic screen.

17. A method of playing a Blackjack game according to claim 14 wherein said predetermined plurality of two-card winning combinations comprises a pair of aces.

18. A method of playing a Blackjack game according to claim 17 wherein said two-card winning combination, with the exception of aces, must be a non-pair.

19. A method of playing a Blackjack game according to claim 14 wherein said plurality of two-card winning combinations comprises an ace and another card which has a value other than ten.

20. A method of playing a Blackjack game according to claim 14 wherein said plurality of two-card winning combinations comprises an ace and another card having a value of two through nine.

21. A method of playing a card game comprising the steps of:

providing a deck of cards comprising a plurality of different numerical values;

providing at least one player with the opportunity to place a single wager on whether the first two cards displayed to said player will be one of a predetermined plurality of two-card winning combinations, and wherein said plurality of two-card winning combinations comprises a first winning combination of cards having at least one cumulative value of two to thirteen and a second winning combination of cards having at least one cumulative value of fourteen to twenty;

initially displaying two cards to each player; and resolving each wager by providing a winning payout to a player who placed a correct wager.

22. A method of playing a card game according to claim 21 wherein said cards are displayed on a game board.

23. A method of playing a card game according to claim 21 wherein said cards are displayed on an electronic screen.

24. A method of playing a card game according to claim 21 wherein said plurality of two-card winning combinations comprises cards having a cumulative value of 12 to 16.

25. A method of playing a card game according to claim 24 wherein said two-card winning combination comprises a pair of aces.

26. A method of playing a card game according to claim 24 wherein said plurality of two-card winning combination comprises an ace and another card which has a value of other than ten.

27. A method of playing a card game according to claim 25 wherein said two-card winning combination having a cumulative value of 12 to 16 must be a non-pair with the exception of aces.

28. A method of playing a card game according to claim 24 wherein said plurality of two-card winning combinations comprises an ace and another card which has a value of two through nine.

29. A method of playing a card game according to claim 21 further comprising the steps of:

requiring each player to wager on whether the player's hand will have had a cumulative value which is closer to a predetermined value than a dealer's hand; and displaying a dealer's hand.

* * * * *